United States Patent [19]

Law

[11] 4,026,486

[45] May 31, 1977

[54] PAPER REEL STANDS

[76] Inventor: Arthur Duerden Law, 60 Thomas St., East Brighton, Victoria, Australia, 3187

[22] Filed: July 27, 1976

[21] Appl. No.: 709,177

[52] U.S. Cl. ..... 242/58.6

[51] Int. Cl.[2] ..... B65H 19/30

[58] Field of Search ..... 242/58.6, 58.2, 79; 214/DIG. 4, 1 BB

[56] References Cited

UNITED STATES PATENTS

| | | | |
|---|---|---|---|
| 1,339,460 | 5/1920 | Langston | 242/58.6 |
| 2,984,429 | 5/1961 | Huck | 242/58.6 X |
| 3,298,667 | 1/1967 | Grantham | 242/58.6 X |
| 3,458,147 | 7/1960 | Teske | 242/58.6 |

*Primary Examiner*—Edward J. McCarthy
*Attorney, Agent, or Firm*—Lawrence E. Laubscher

[57] ABSTRACT

This invention provides a paper reel stand, for supplying a web of paper to a paper processing machine, which lifts the paper roll into a feeding position and provides accurate feed alignment of the web from the roll, tension control on the web and prevents over-run in the event of the machine stopping or slowing down, said stand including a frame having at each side thereof a lifting means each operable from a common power source and each arranged to engage a shaft to rotatably support a paper roll and raise the latter to a paper feeding position on the stand, a frame pivotally mounted in the stand with its free end movable to and remote from an operating position adjacent the perimeter of the paper roll where adjustable means on said free end engage the paper roll to control feed alignment of the web and the tension imparted to the web and to prevent over-run when take-off from the roll stops or slows down.

11 Claims, 14 Drawing Figures

2
54
66
55
52
84
56
57
58
42
37
43
45
30
29
49
26
53
51
2
28
16
16b
44
59
31
15
50

10
13
86
84
80
82
55
54
55a
12
10
13
12
52
51
3
18
32
16a
31
29
28
30
16
3
86
84
81
55
80
85
87
83
54
52
53
51
18
17
29
17a

PAPER REEL STANDS

This invention relates to paper reel stands for supporting rolls of paper for feeding to a paper processing machine.

In the handling of paper rolls for mounting in a paper processing machine there is difficulty in lifting the roll on the machine reel support, particularly, when the rolls are of large size, and to accurately align the paper web drawn from the roll for feeding into the machine together with maintainance of the roll in lateral position, and providing tension control of the web and to prevent over-run of the web when the machine stops or slows down.

The principal object of the present invention is to provide a paper reel stand arranged to lift a paper roll from the ground to a feeding position in the stand, provide for accurate feed alignment of the web from the roll, tension control and over-run of the web.

According to the invention a paper reel stand, for supplying a web of paper to a paper processing machine, includes a frame having at each side thereof a jack or like lifting means, each operable from a common power source and each arranged to engage a shaft adapted to rotatably support a paper roll to raise the latter to a paper feeding position on the stand, a counter-poise or like frame mounted on the stand and with the free end of said latter frame movable to and remote from an operating position adjacent the perimeter of the paper roll, the frame having at the free end thereof adjustable means for engaging the paper roll to control feed alignment of the paper web from the roll and the tension imparted to the web being fed from the roll and to prevent over-run of the roll when take-off of the web from the roll stops or slows down.

The pair of jacks or like lifting means may each comprise a screw thread arranged in a side post of the stand frame, engaged by a running nut, guided relatively to the post and having means associated therewith to engage the roll shaft, the screw thread of each jack being drive coupled to a common reversible electric motor to rotate the screw-threads in a required direction and controlled by limit switches to limit the movement of the associated nuts in either direction.

The free end of the counter-poise frame includes a transverse shaft which at each end is supported in such a manner to provide limited adjustable axial movement and to prevent rotation of the shaft. The support means includes adjustable opposed spring means to permit the shaft to move relatively to the opposed springs. The shaft also has mounted thereon adjustably spaced rollers to ride upon the perimeter of the paper roll adjacent to the take-off point of the paper web. Between the rollers and the adjacent shaft end support is located an adjustable clamp member each carrying a friction member and a roller to be selectively positioned to abut the side edge of paper roll to locate the roll in a required aligned position. One of said clamp members includes a screw means arranged to move its associated friction member and roller axially of the transverse shaft to adjust the pressure of the friction members or rollers on the sides of the paper roll.

In order that the invention may be more readily understood reference will now be made to the accompanying drawings illustrating a practical embodiment of a paper reel stand constructed according to the present invention.

IN THESE DRAWINGS

Figure 2:
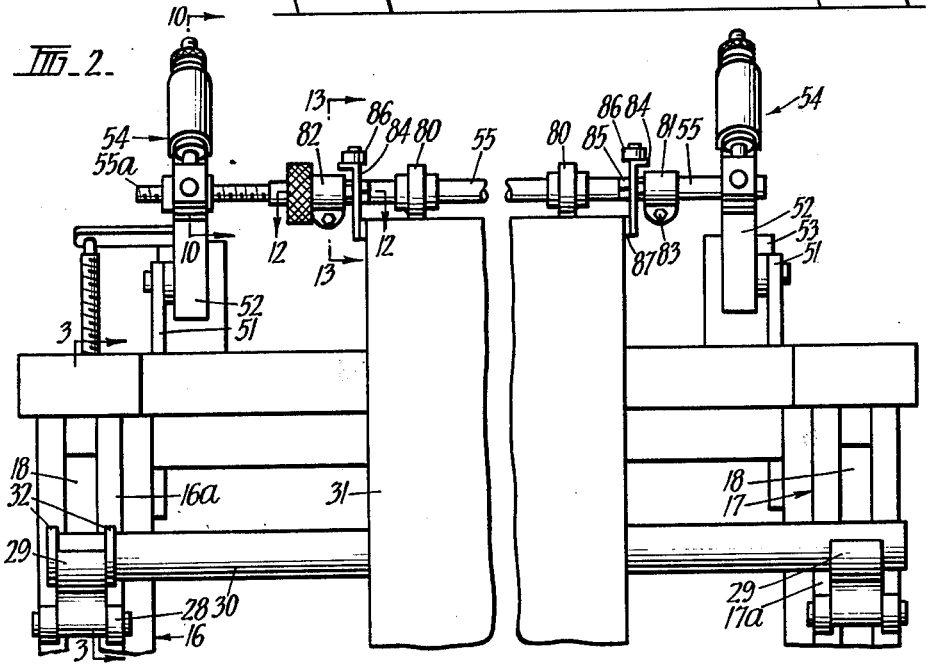
FIG. 2 is an elevation on the line 2—2 of FIG. 1.
Figure 3:
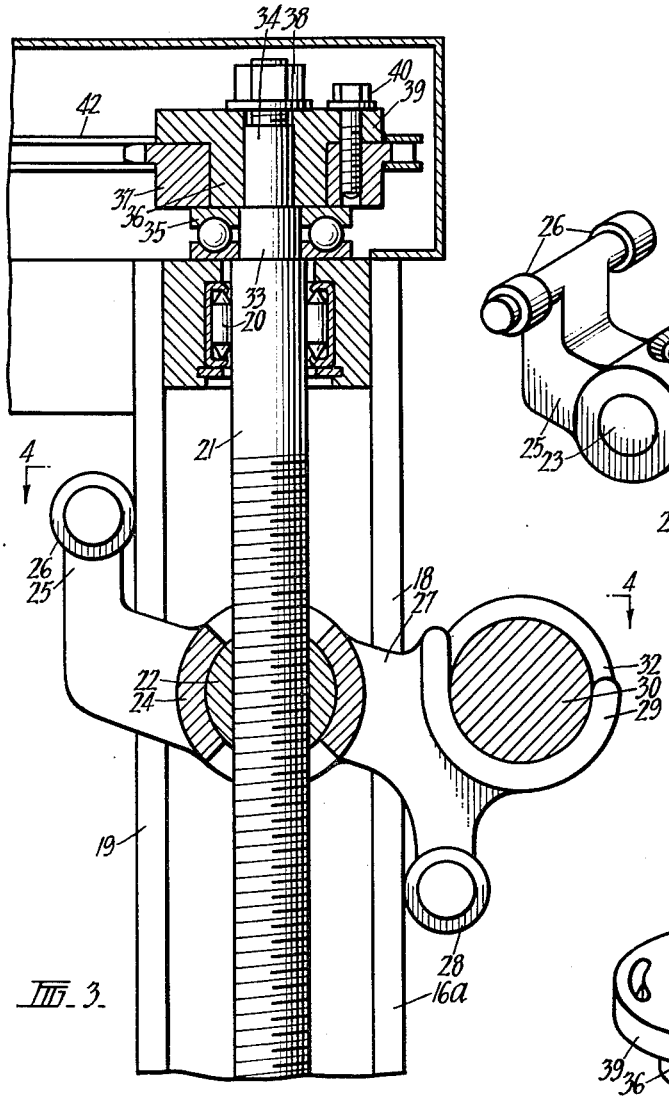
FIG. 3 is a section of one of the reel jacks on line 3—3 of FIG. 2.
Figure 5:
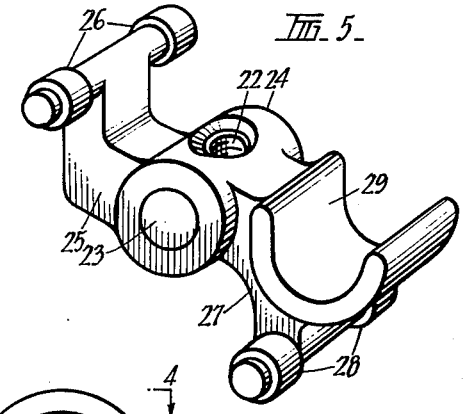
FIG. 5 is a detail perspective view of a jack lifting member.
Figure 6:
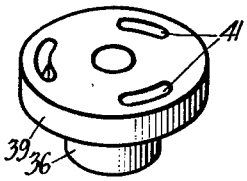
FIG. 6 is a detail perspective view of means for connecting a lifting jack screw to its drive sprocket and to enable the lifting means of the jacks to be levelled.
Figure 4:
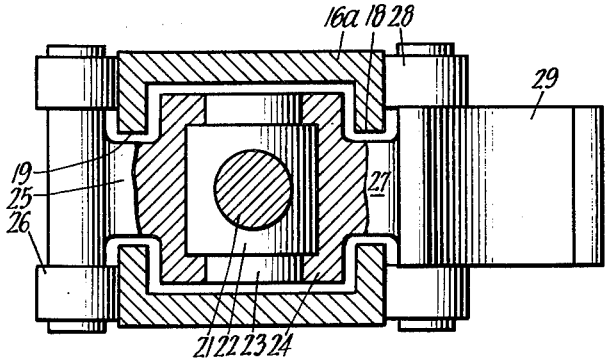
FIG. 4 is a section of the jacks on line 4—4 of FIG. 3.
Figure 7:
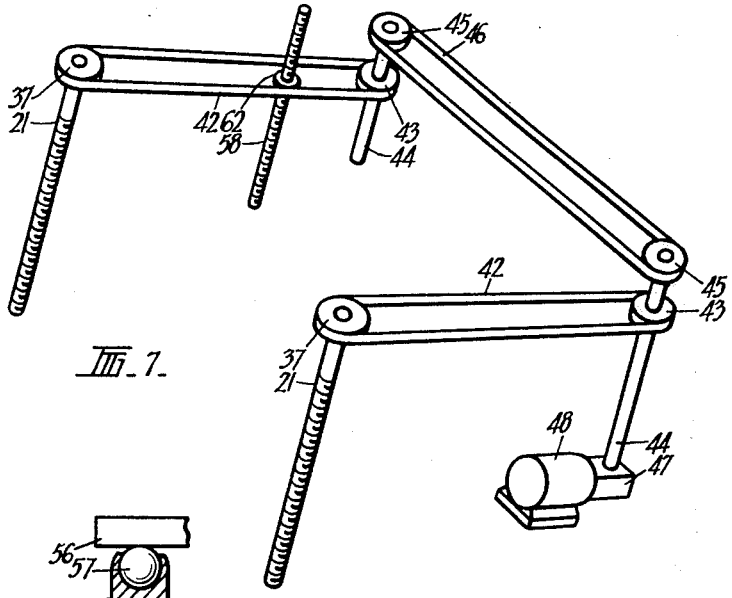
FIG. 7 is a diagrammatic view of the drive for the paper reel lifting jacks and the jack for lowering or raising the counter poise as the lifting jacks are raised and lowered.
Figure 8:
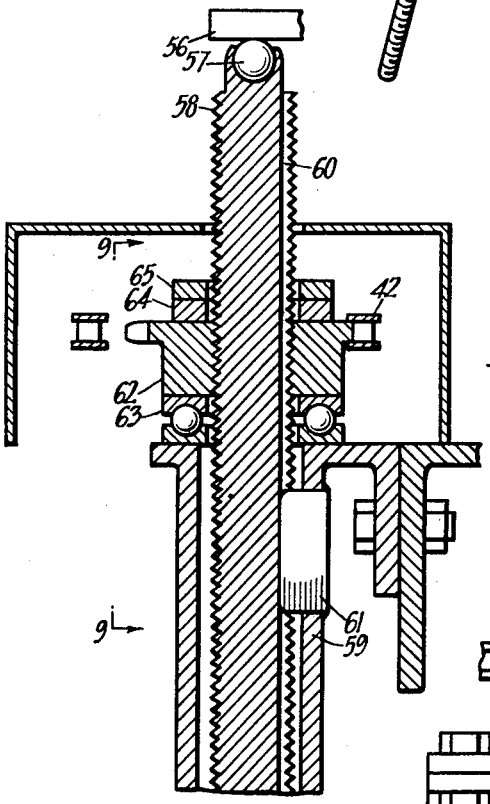
FIG. 8, is a detail sectional view of the counter poise lifting jack.
Figure 9:
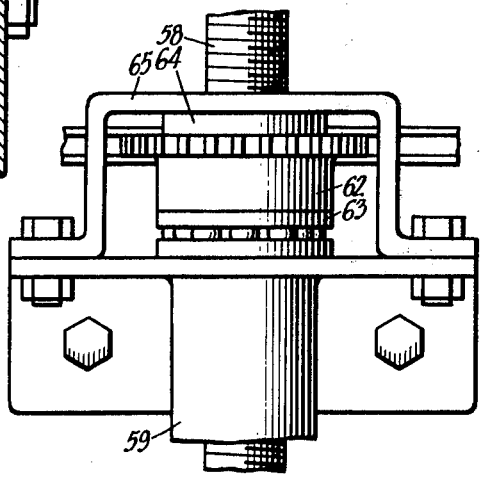
FIG. 9, is an elevation on the line 9—9 of FIG. 8.

As illustrated in the drawings the paper reel stand comprises a base 15 having two open side frames 16 and 17 with slightly rearwardly inclined front posts **16*a* and 17*a* and rear posts 16*b*. The front posts 16*a* and 17*a* are hollow and parallel with front and rear slots 18 and 19 (FIGS. 2, 3 and 4**).

Within each front post **16*a* and 17*a* and rotatably supported in end bearings 20 is a screw 21 having a tubular nut 22 thereon, said nut having side pins 23 pivoted in a cage 24 permitting limited movement of the cage in a plane normal to the screw 21. An extension 25 from each nut cage 24 extends respectively through the rear slot 19 in the posts 16*a* or 17*a* and projects upwardly and carries a pair of rollers 26 each of which bears on the post each side of the slot 19 therein. A front extension 27 on the cage 24 extends through the front slot 18 in the post and projects downwardly and carries a pair of rollers 28, each of which bears on the post each side of the slot 18**.

The forward extension 27 has a hook formation 29 which is adapted to engage a shaft support 30 for a paper roll 31. The screws 21, nuts 22, cages 24, extensions 25 and 27 and rollers 26 and 28 associated in the posts **16*a* and 17*a* constitute lifting jacks so that the hooks 29 in a lowered position enable a paper roll 31 to be rolled in position between the posts 16*a* and 17*a* with the support shaft 30 above the hooks 29 and upon rotation of the screws the hooks will raise the roll into an operative position with the rollers 26 and 28 taking the weight of the roll. Preferably the shaft 30 is provided with spaced collars 32 at one end thereof to provide a seat for a hook 29 and prevent axial movement of the shaft 30** when paper from the roll is being delivered from the stand.

Each screw 21 has at the upper end shouldered extensions 33 and 34, the inner extension 33 having a thrust bearing 35 thereon and the outer extension 34 has a flanged boss 36 thereon, the boss of which latter carries a chain sprocket 37. The flanged boss 36 is secured to the screw shaft 21 by nut 38 and the sprocket 37 secured to the flange 39 of the boss 36 by bolt 40 which is selectively screwed through one of the slots 41 in the flange 39, the arrangement being such that the screws 21 may be adjusted to level the lifting hooks 29 independently of the drive of the sprockets 37.

Figure 1:
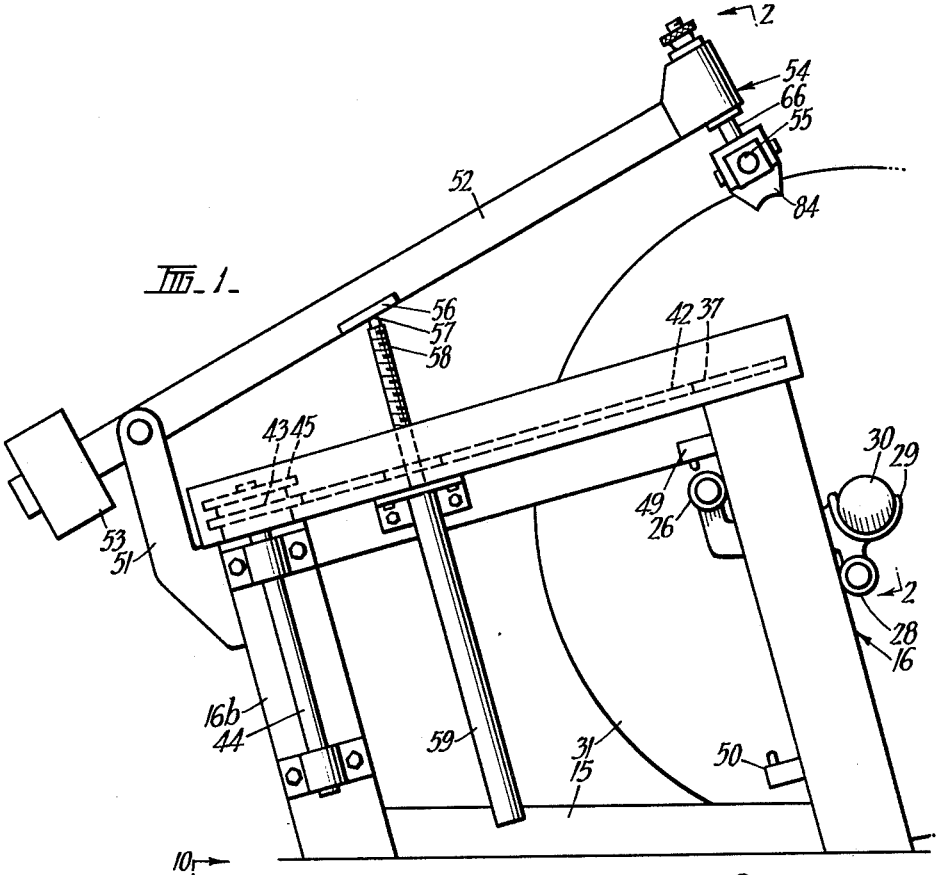
FIG. 1 is a side elevation of a paper reel stand.

Each sprocket 37 is driven by a chain 42 coupled to a sprocket 43 on a counter shaft 44 rotatably supported in bearings on a corresponding rear post 16*b*. Each counter shaft 44 has a second sprocket 45 thereon each driven by a chain 46. One counter shaft 44 constitutes a drive shaft driven through a worm drive 47 by a reversible electric motor 48. The arrangement is such that by rotating the motor 48 through a control switch (not shown) in a required direction the screws 21 are rotated to move the lifting hooks 29 on the front posts 16*a* and 17*a* upwardly or downwardly; limit switches 49 and 50 are provided on one post (FIG. 1) to be actuated by extension 25 of one of the lifting hooks 29 so that the motor 48 is switched off upon the lifting hooks 29 reading the limit of their movement in either direction.

The above described construction and drive arrangement for the lifting hooks 29 ensures that the hooks move parallely and level so that in the lowermost position a paper roll 31 may be rolled between the posts 16*a* and 17*a*, the shaft 30 passed through the roll, the hooks raised to lift the roll into a paper feeding position.

Pivotally mounted to each rear post 16*b*, on a bracket 51, is an arm 52 having a counter-weight 53 at the outer end thereof. The inner part of each arm 52 extends forwardly to a position above the paper roll lifting mechanism. The inner end of each arm has a mounting 54 supporting a transverse shaft 55 in a suspended manner. The arms 52 and shaft 55 form a open rectangular counter-balanced frame, with the shaft 55 tending to drop towards and contact the top of the paper roll 31. One arm 52 has a side lug 56 which is engaged on the underside by a ball 57 in the end of a threaded rod 58 (FIGS. 2, 7, 8 and 9). The threaded rod 58 is carried in sleeve 59 fixed to side frame 16, the rod is provided with a longitudinal keyway 60 engaged by a fixed key 61 secured in the sleeve 59 to prevent the rod 58 from rotating. The threaded rod 58 is also engaged by a sprocket-nut 62 which is supported between bearings 63 and 64, the sprocket-nut 62, and bearings 63 and 64 being held in operative position by an apertured bracket 65 through which the rod 58 extends. The sprocket-nut 62 engages the inner run of one of the chains 42 driving the lifting jack screw 21 of post 16*a*, the arrangement being such that the screw 58 is operated to lift the counterbalanced frame when the lifting hooks 29 are being lowered and to lower the said frame when the hooks 29 are being raised so that the transverse shaft 55 of said frame is lowered onto the top of the paper roll 31. The frame and shaft 55 are lifted clear of a paper roll when the stand is being re-loaded with a fresh roll.

Figure 10:
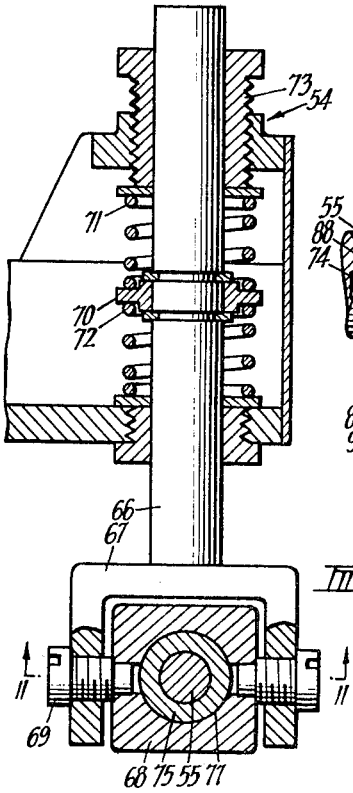
FIG. 10 is a detail sectional view of one of the mountings of the transverse shaft to the counter poise.
Figure 11:
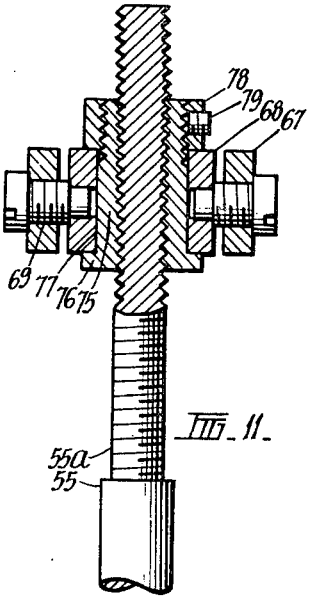
FIG. 11 is a section on line 11—11 of FIG. 10.

The transverse shaft 55 is supported at its ends by the mountings 54 at each end of arms 52, each mounting 54 comprises a suspension rod 66 having at its lower end a fork 67 which carries a block 68 pivotally connected to the fork by pivot screws 69 (FIGS. 10 and 11).

The suspension rod 66 has a collar 70 within the mounting 54 and which separates two compression springs 71 and 72 each of which respectively abut the collar 70 and the inside of the mounting 54. The upper end of the mounting is in the form of a tube nut 73 the inner end of which abuts the upper spring 71 so that adjustable pressure may be imparted to the collar 70 and rod 66 through the springs 71 and 72.

The shaft 55 has a keyway 74 extending for the major part of its length and at one end (right end FIG. 2) the pivoted block 68 at that end has a key (not shown) to engage the keyway 74 and thereby prevail the shaft 55 from rotating but permitting longitudinal movement of the shaft. The other end of the shaft 55 is threaded as at 55*a* and which is received in an internally threaded sleeve 75 having a flanged end 76, said sleeve 75 engaging an aperture 77 in one of the blocks 68 supported in mounting 54 as shown at the left in FIG. 2 and in detail in FIGS. 10 and 11. The sleeve 75 is threaded at one end to receive a collar 78 retained by a grub screw 78 whereby the sleeve 75 is retained in the block 68 in an adjusted position on the threaded part 55*a* of the shaft 55.

Two rollers 80 are arranged on the shaft 55 and are arranged to be adjustably spaced and secured in required position to bear upon the top of the paper roll 31.

On the shaft 55 and between a roller 80 and shaft end support block 68 is a clamp member 81, at the right, and a clamp member 82, at the left as seen in FIG. 2. Each clamp member 81 and 82 is slidable along the shaft 55 and adapted to be clamped by screws 83 at determined positions on the shaft. Each clamp member has a lug 84 supported thereon by spaced studs and nuts 85, each lug 84 having on opposite ends thereof a roller 86 and a friction member 87, the arrangement being such that by reversing the lugs 84 on the studs 85 either the rollers 86 or friction members 87 may be set to abut the side edge of the paper roll 31, when the arms 52 are lowered and the rollers 80 contact the upper perimeter of the paper roll 31, as shown in FIG. 2.

Figure 12:
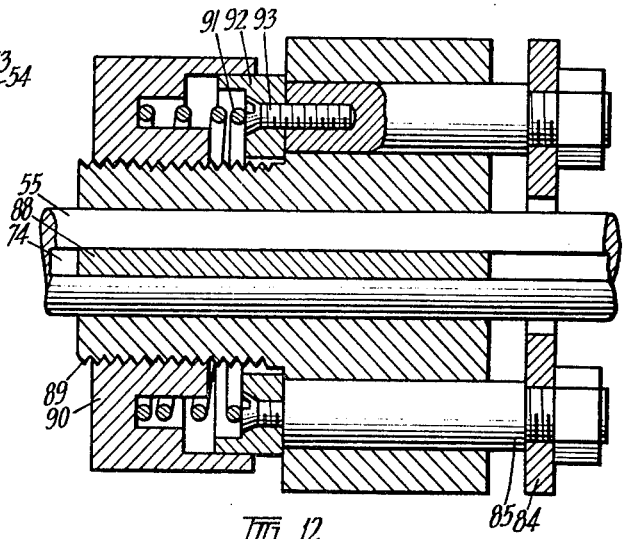
FIG. 12, is a section on line 12—12 of FIG. 2 of the means on the transverse shaft for supporting the friction member and roller and to adjust the pressure thereof on the sides of the paper roll.
Figure 13:
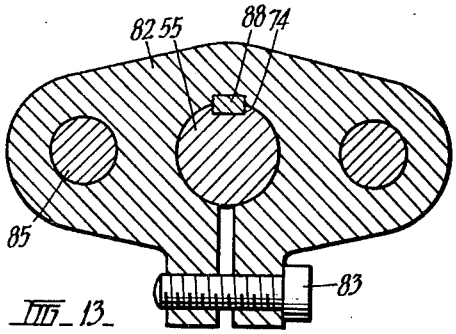
FIG. 13 is a section on line 13—13 of FIG. 2 of the friction member and roller support.
Figure 14:
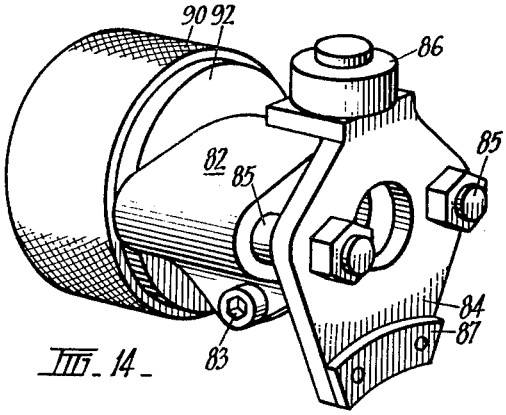
FIG. 14 is a detail perspective view thereof.

The clamp member 82, as seen at the left of FIG. 2 and as detailed in FIGS. 12, 13 and 14, has a key 88 which prevents that clamp member from rotating on the shaft 55, the clamp also having a rearward threaded boss 89 which has a thimble 90 thereon. Within the thimble is a compression spring 91 which bears upon the inner face of the thimble and a pressure ring 92 onto the outer face of which is attached the end of studs 85 by screws 93. The studs 85 are slidable in the clamp member 82 so that the lug 84 carrying the roller 86 and friction member 87 is urged outwardly by adjustable pressure applied by the spring 91 and thimble 90.

The right hand clamp member 81 is fixed in position with a roller or friction member abutting the side of the paper roll after the roll has been aligned for feeding the paper into a paper web processing machine. The left hand clamp member is moved along the shaft 55 until its roller or friction member abuts the other side of the paper roll, the member is then clamped to the shaft when the thimble adjusted so that a required pressure is imparted to the roller or friction pad.

The rollers 86 and friction members 87 are adapted to provide adjustable pressure on each side of the paper roll to maintain the roll in alignment with the paper processing machine with which the reel stand is associated. Accurate alignment adjustment of the roll may also be effected by adjusting the shaft 55 longitudinally by means of the sleeve 75 in the block 68.

The friction members 87 and rollers 85 assist in preventing over-run of the roll when the paper processing machine stops or slows down. The friction members are used for heavy weight paper rolls and the rollers for light weight paper rolls.

The paper reel stand as above described enables a paper roll to be readily lifted into feeding position for a paper web processing machine and the various adjustments incorporated on the rider shaft enable the roll and web to be accurately positioned for feed alignment.

What I claim is:

1. A paper reel stand, for supplying a web of paper to a paper processing machine, including a frame having at each side thereof a lifting jack, a common power source to operate each lifting jack and each jack arranged to engage a shaft adapted to rotatably support a paper roll to raise the latter to a paper feeding position on the stand, a counter poise frame pivotally mounted on the stand and with the free end of said latter frame movable to and remote from an operating position adjacent the perimeter of the paper roll, said frame having at the free end thereof adjustable means for engaging the paper roll to control feed alignment and tension imparted to the web being fed from the roll and to prevent over-run of the roll when take-off of the web from the roll stops or slows down.

2. A paper reel stand for supplying a web of paper to a paper processing machine including a frame having at each side thereof a lifting jack each comprising a screw thread rotatably arranged in a side post of the stand frame, a running nut on the screw thread, means associated with the nut to engage a shaft adapted to rotatably support a paper roll said means being guided relatively to the post, the screw thread of each jack being drive coupled to a common reversible driving means to rotate the screw threads in a required direction for raising the paper roll to or from a paper feeding position on the stand, a counter poise frame pivotally mounted on the stand and with the free end of said latter frame movable to and remote from an operating position adjacent the perimeter of the paper roll, said frame having at the free end thereof adjustable means for engaging the paper roll to control feed alignment and tension imparted to the web being fed from the roll and to prevent over-run of the roll when take-off of the web from the roll stops or slows down.

3. A paper reel stand as claimed in claim 2 and wherein the screw threads of each jack are driven by a common reversible electric motor, and with limit switches in the energizing circuit thereof to limit the movement of associated lifting jacks in either direction.

4. A paper reel stand as claimed in claim 2 and wherein the side posts having the screw threads therein are slotted and the running nut on each screw is enclosed in a cage to which it is pivoted, said cage having members extending through the post slots and carry rollers to bear on the post on each side of the slots therein, and with one of said extension members having a hook member formed thereon to engage the roll supporting shaft.

5. A paper reel stand as claimed in claim 2 and wherein the counter poise frame is moved by drive means coupled to the drive for the lifting jacks so that said frame is moved to an operating position as the jacks are raised and moved to an inoperative position as the jacks are lowered.

6. A paper reel stand as claimed in claim 2 and wherein the free end of the counter poise frame comprises a transverse shaft supported in means to provide limited adjustable axial movement and to prevent rotation of the shaft, adjustably spaced rollers on the shaft to ride upon the perimeter of the paper roll adjacent the take-off point of the paper web when the said frame is in the lowered operative position and an adjustable clamp member between a roller and each shaft end support, each clamp member carrying a friction member and a roller to be selectively positioned to abut the side edge of the paper roll to locate the roll in a required aligned position.

7. A paper reel stand as claimed in claim 6 and wherein one of the adjustable clamp members includes screw means arranged to move its associated friction member and roller axially of the transverse shaft to adjust the pressure of the friction members or rollers on both clamp members on the sides of the paper roll.

8. A paper reel stand as claimed in claim 7 and wherein the screw means includes a thimble enclosing a compression spring arranged to provide adjustable pressure on slidable studs detachably supporting on their other ends a bracket carrying the friction member and the roller.

9. A paper reel stand as claimed in claim 6 and wherein the friction member and roller on each clamp member are respectively supported on each end of a bracket detachably secured to the clamp member, said bracket being reversible to selectively arrange the friction member or roller to an operative position.

10. A paper reel stand as claimed in claim 6 and wherein each end of the transverse shaft forming the free end of the counter poise frame is supported in a block pivotally carried in a fork at the end of a suspension rod which is slidably supported in a mounting at the end of a side member of said frame, said rod having a collar within said mounting which is acted upon by compression springs on each side thereof and with a tube nut acting on one of the springs to adjust the influence of said springs on said rod.

11. A paper reel stand as claimed in claim 10 and wherein one block supporting one end of the transverse shaft is arranged to provide axial movement of the shaft but prevent rotation of the shaft and the block supporting the other end of the shaft is engaged by an internally threaded and collared sleeve which engages a threaded end of the shaft and rotation of the sleeve enables the shaft to be axially adjusted relatively to its support mountings.

* * * * *